US007121541B2

(12) United States Patent
Saito et al.

(10) Patent No.: US 7,121,541 B2
(45) Date of Patent: Oct. 17, 2006

(54) STAPLING APPARATUS, SHEET FINISHING APPARATUS, AND IMAGE FORMING APPARATUS EQUIPPED WITH THE SHEET FINISHING APPARATUSES

(75) Inventors: Takashi Saito, Yamanashi-ken (JP); Hiroki Imazu, Minami-Alps (JP)

(73) Assignee: Nisca Corporation, Yamanashi-Ken (JP)

( * ) Notice: Subject to any disclaimer, the term of this patent is extended or adjusted under 35 U.S.C. 154(b) by 186 days.

(21) Appl. No.: 10/836,380

(22) Filed: May 3, 2004

(65) Prior Publication Data

US 2004/0232610 A1 Nov. 25, 2004

(30) Foreign Application Priority Data

May 20, 2003 (JP) ..... 2003-141392
May 28, 2003 (JP) ..... 2003-150033

(51) Int. Cl.
*B27F 7/36* (2006.01)

(52) U.S. Cl. ..... 270/58.09; 270/58.08; 227/2; 399/410

(58) Field of Classification Search ..... 270/58.08, 270/58.09; 227/2, 4; 399/410
See application file for complete search history.

(56) References Cited

U.S. PATENT DOCUMENTS 5,413,266 A * 5/1995 Jairam ..... 227/129
6,398,203 B1 6/2002 Saito et al.
6,565,075 B1 * 5/2003 Ishizaki ..... 270/58.09
6,607,188 B1 * 8/2003 Sato et al. ..... 270/58.09
6,616,027 B1 9/2003 Mochizuki
6,948,224 B1 * 9/2005 Coombs et al. ..... 29/407.01

FOREIGN PATENT DOCUMENTS

JP 9-267967 10/1997
JP 2001-058756 3/2001
JP 2001-58765 3/2001
JP 2002087693 A * 3/2002

* cited by examiner

*Primary Examiner*—Khoi H. Tran
(74) *Attorney, Agent, or Firm*—Manabu Kanesaka

(57) ABSTRACT

A staple apparatus includes a support tray for stacking sheets into a sheet bundle, a head unit arranged at a position away from the support tray and having a drive device for driving a staple into the sheet bundle, an anvil unit arranged on the support tray for bending the staple driven into the sheet bundle, and a staple operating device for pressing the head unit against the anvil unit and for separating the head unit from the anvil unit. A cover member is arranged to freely open and close a space for the stapling operation between the head unit and the anvil unit, and a control device controls the staple operating device not to operate when the cover member is not positioned at the closed position.

9 Claims, 11 Drawing Sheets

STAPLING APPARATUS, SHEET FINISHING APPARATUS, AND IMAGE FORMING APPARATUS EQUIPPED WITH THE SHEET FINISHING APPARATUSES

BACKGROUND OF THE INVENTION AND RELATED ART STATEMENT

The present invention relates to a stapler apparatus for stacking and stapling sheets with images formed by an image forming apparatus such as a copier, printer or printing machine to form a bundle, a sheet finishing apparatus used as an end unit apparatus of an image forming apparatus, and an image forming apparatus equipped with the sheet finishing apparatus.

In general, a stapler apparatus for binding sheets includes a head unit with staple drive means called a driver for driving a staple and an anvil unit with bending means such as a clincher for bending leading ends of the staple. The head unit and the anvil are arranged at opposing positions with a sheet bundle therebetween. One of the head unit and the anvil unit is moved downward rapidly to penetrate a U-shaped staple into a sheet bundle, and the anvil unit bends the leading ends of the staple. Such an apparatus has been well known in the art.

A variety of sheet finishing apparatuses have been known as an end unit apparatus of an image forming apparatus, in which sheets with images are stacked and aligned on a processing tray. Then, a stapler apparatus disposed in the processing tray binds the sheet bundle, and the sheet bundle is stored on a stacking tray.

The stapler apparatus disposed in such a sheet finishing apparatus is provided with a staple cartridge in the head unit thereof. A roll or a sheet of straight staples joined together into a band or belt shape is stored in the cartridge. A former member disposed in the head unit bends the straight staple into a U-shape, and the driver member drives the U-shaped staple into the sheet bundle. A clincher disposed in the anvil bend bends the leading ends of the staple to bind the sheet bundle.

An operation of stapling is completed in a series of movements of the head unit from a position away from the anvil unit to a position contacting the anvil unit. A rotating cam connected to a drive motor directly moves the anvil unit, or a servo mechanism such as a lever moves the anvil unit.

Accordingly, the head unit and anvil unit are arranged apart for a distance with the sheet bundle therebetween, and move (normally, one of the head unit and anvil unit) rapidly to a contact position, so that the staple penetrates into the sheet bundle. It is possible that a loud noise is generated during the stapling operation. If a finger of an operator or other foreign object is inserted into the apparatus during the operation, it is possible to cause an accident or malfunction.

Recently, the size of the sheet finishing apparatus has been reduced, and the stapler apparatus tends to be disposed near a paper removal outlet of a stacker for storing the sheet bundle. In such a structure, it is possible that an operator touches the mechanism of the stapler apparatus when removing a sheet. It is also possible that the operator touches the apparatus when a problem such as staple jam occurs. If the stapler apparatus is operated when the operator touches the apparatus, the operator may get injured. Further, the stapler apparatus causes the problem of generating noise during the operation or jamming a foreign object.

In order to prevent the problems of noise or intrusion of a foreign object, an apparatus has been known in which rollers are provided for discharging the sheet bundle after stapling. The rollers are arranged to move vertically between an open position and a closed position, and the rollers are closed during the operation of stapling.

Japanese Patent Publication (Kokai) No. 2001-058756 has disclosed such an apparatus in which rollers are disposed at a side of a trailing edge of the sheet bundle relative to a stapler disposed at a leading edge of the sheet bundle. The rollers move to contact the sheet bundle during the stapling operation. However, such a structure is limited to an apparatus with a specific configuration. In particular, in an apparatus in which a stapler apparatus is arranged at the leading edge of the sheet bundle and the sheet bundle is removed from a backside of the stapler apparatus, it is difficult to prevent a finger from inserting or a foreign object from jamming. In the apparatus disclosed in Japanese Patent Publication (Kokai) No. 2001-058756, it is possible that the stapling operation could accidentally occur when the rollers are retracted from the sheet bundle and a finger of an operator is inserted.

When the stapler apparatus runs out the staples after the binding operation, it is necessary to replace the staple cartridge to replenish the staples. In addition, when a staple is jammed because of a wrong operation of stapling, it is necessary to remove the stapler apparatus from the finishing apparatus. In a conventional apparatus, a part of an external cover of the finishing apparatus is arranged to open, and faces a frame of the finishing apparatus mounted with the stapler apparatus. For example, in the stapler apparatus disclosed in Japanese Patent Publication (Kokai) No. 2001-058765, a cover is opened so that a staple cartridge is removed from the stapler apparatus. When a staple is jammed, the jam is handled while the stapler apparatus is still mounted to the finishing apparatus. In a stapler apparatus disclosed in Japanese Patent Publication (Kokai) No. 09-267967, it is necessary to remove the stapler apparatus from a finishing apparatus to replace a staple cartridge.

In the stapler disclosed in Japanese Patent Publication (Kokai) No. 2001-058765, it is necessary to remove the jam while the stapler apparatus is still mounted to the finishing apparatus, thereby complicating the work and deteriorating operability. In the stapler apparatus disclosed in Japanese Patent Publication (Kokai) No. 09-267967, the stapler apparatus is detachably mounted to the finishing apparatus. It is necessary to frequently remove the unit each time when the staples are replenished and return the unit at a right position, thereby making the work tedious. In particular, when the stapler apparatus is arranged at a backside of the sheet finishing apparatus, it is difficult to handle a staple jam.

In view of the problems describe above, an object of the present invention is to provide a stapler apparatus applicable to a variety of sheet finishing apparatuses and a sheet finishing apparatus provided with the stapler apparatus, wherein it is possible to prevent a finger of an operator or a foreign object from inserting into a staple mechanism. Even if a finger of an operator or a foreign object is inserted into the staple mechanism, it is still possible to prevent an injury or an accident.

Another object of the present invention is to provide a stapler apparatus mounted to a sheet finishing apparatus, wherein it is easy to replenish staples or remove a jammed staple, and it is possible for an operator to safely mount or remove a stapler apparatus relative to a sheet finishing apparatus.

Further objects and advantages of the invention will be apparent from the following description of the invention.

SUMMARY OF THE INVENTION

To attain the objects described above, according to a first aspect of the present invention, a stapler apparatus includes a head unit having staple driving means, an anvil unit having bending means, and a cover member disposed at a space for a stapling operation between the head unit and the anvil unit to be freely opened. When the cover member is not at a closed position (closed region), the stapling operation is prohibited. Accordingly, an operator does not inadvertently insert a finger and get injured, and it is possible to reduce noise of the operation.

Specifically, the staple apparatus includes a support tray for stacking sheets into a sheet bundle; the head unit arranged at a position away from the support tray and having the drive means for driving a staple into the sheet bundle; the anvil unit arranged on the support tray for bending the staple driven into the sheet bundle; staple operating means for pressing the head unit against the anvil unit and for removing the head unit from the anvil unit; the cover member arranged to freely open and close the space for the stapling operation between the head unit and the anvil unit; and control means for controlling the staple operating means not to operate when the cover member is not positioned at the closed position. Accordingly, an operator does not inadvertently insert a finger and get injured, and it is possible to reduce noise of the stapling operation.

In the structure described above, the cover member is arranged to freely open and close in a direction that the head unit moves, and freely move between a closed position where the cover member contacts the sheet bundle and an open position away from the sheet bundle. The cover member is connected to opening/closing drive means for moving the cover member in an opening direction and a closing direction. In the staple apparatus, it is possible to move the cover member from the open position to the closed position before the stapling operation. Accordingly, it is possible to perform the stapling operation after it is determined whether a finger or a foreign object is in the space for the stapling operation.

In the structure described above, the staple operating means has a drive motor, and the control means is configured to shut off electrical power supplied to the drive means. Accordingly, it is possible to prohibit the stapling operation with a simple structure without any special mechanical means.

According to a second aspect of the present invention, a sheet finishing apparatus includes discharge means for sequentially discharging sheets; a support tray for stacking the sheets into a sheet bundle; a head unit having drive means for driving a staple into the sheet bundle; an anvil unit arranged on the support tray for bending the staple driven into the sheet bundle; staple operating means for pressing the head unit against the anvil unit and for separating the head unit from the anvil unit; a discharge stacker for storing the sheets on the support tray; a cover member arranged to freely open and close a space for a stapling operation between the head unit and the anvil unit; and control means for controlling the staple operating means not to operate when the cover member is not positioned at the closed position. Accordingly, it is possible to staple the sheets discharged from an image forming apparatus and store the sheet bundle in the discharge stacker in a continue process, thereby safely operating the sheet finishing apparatus.

According to a third aspect of the present invention, a sheet finishing apparatus includes a guide member for supporting a stapler apparatus to be movable between an operating position and a separated position; removal means disposed in the stapler apparatus for removing a staple cartridge at the separated position; and release means disposed in the guide member for releasing the stapler apparatus at the separated position. In the sheet finishing apparatus, it is possible to move the stapler apparatus from the operating position to the separated position. Accordingly, it is easy to remove the staple cartridge to replenish staples or remove the stapler apparatus to handle a staple jam at the separated position.

Specifically, the sheet finishing apparatus includes a main apparatus with a processing tray for stacking sheets in a bundle; a stapler apparatus with a staple driver for driving a staple into the sheet bundle; a staple cartridge detachably mounted to the stapler apparatus and retaining the staples; the guide member disposed in the main apparatus for supporting the stapler apparatus to be movable between the operating position and the separated position; locking means for locking the stapler apparatus at the operating position; the release means for releasing the stapler apparatus; and the removal means disposed in the stapler apparatus for removing the staple cartridge held by the guide means at the separated position. Accordingly, it is possible to attain the objects described above.

In the sheet finishing apparatus in the third aspect of the present invention, the stapler apparatus may be provided with a drive motor for the staple driver and a connector for supplying electrical power to the drive motor. The main apparatus may include a connector on the power supply side connected to the connector. When the stapler apparatus moves from the operating position to the separated position, the connectors are disconnected. Accordingly, when the stapler apparatus moves from the operating position to the separated position, the power for the drive motor of the stapler apparatus is shut off, thereby improving safety when an operator touches the sheet finishing apparatus.

In the sheet finishing apparatus of the present invention, locking means and releasing means may be provided at the separated position of the guide member for preventing the stapler apparatus form moving to the separated position and the operating position. Accordingly, it is easy to remove or mount the staple cartridge relative to the stapler apparatus without moving the unit.

In the sheet finishing apparatus of the present invention, the locking means and releasing means may be formed of elastic pawl members. The elastic members engage and release the stapler apparatus in a snapping action, thereby making operation and production simple.

In the sheet finishing apparatus of the present invention, sensor means may be provided in at least one of the main apparatus and the stapler apparatus for detecting whether the stapler apparatus is positioned at the operating position. Accordingly, it is possible to staple the sheet bundle when the stapler apparatus is positioned accurately at the operating position.

In the sheet finishing apparatus of the present invention, the guide member may be formed of a guide rail for guiding the stapler apparatus into the stapler apparatus from outside. Accordingly, it is easy to mount and dismount the stapler apparatus relative to the main apparatus along the guide rail.

The sheet finishing apparatus of the present invention may include a stapling unit with a staple driver; a handle portion forming a portion of an external cover; and a linking portion connecting the handle portion and the stapling unit. Accordingly, it is easy to remove the stapler apparatus mounted inside the apparatus through the portion of the external cover of the main apparatus, or mount the stapler apparatus inside the apparatus.

The sheet finishing apparatus having the stapler apparatus described above may be attached to an image forming apparatus having image forming means for forming an images on a sheet, thereby obtaining affects described above.

DETAILED DESCRIPTION OF PREFERRED EMBODIMENTS

Figure 1:
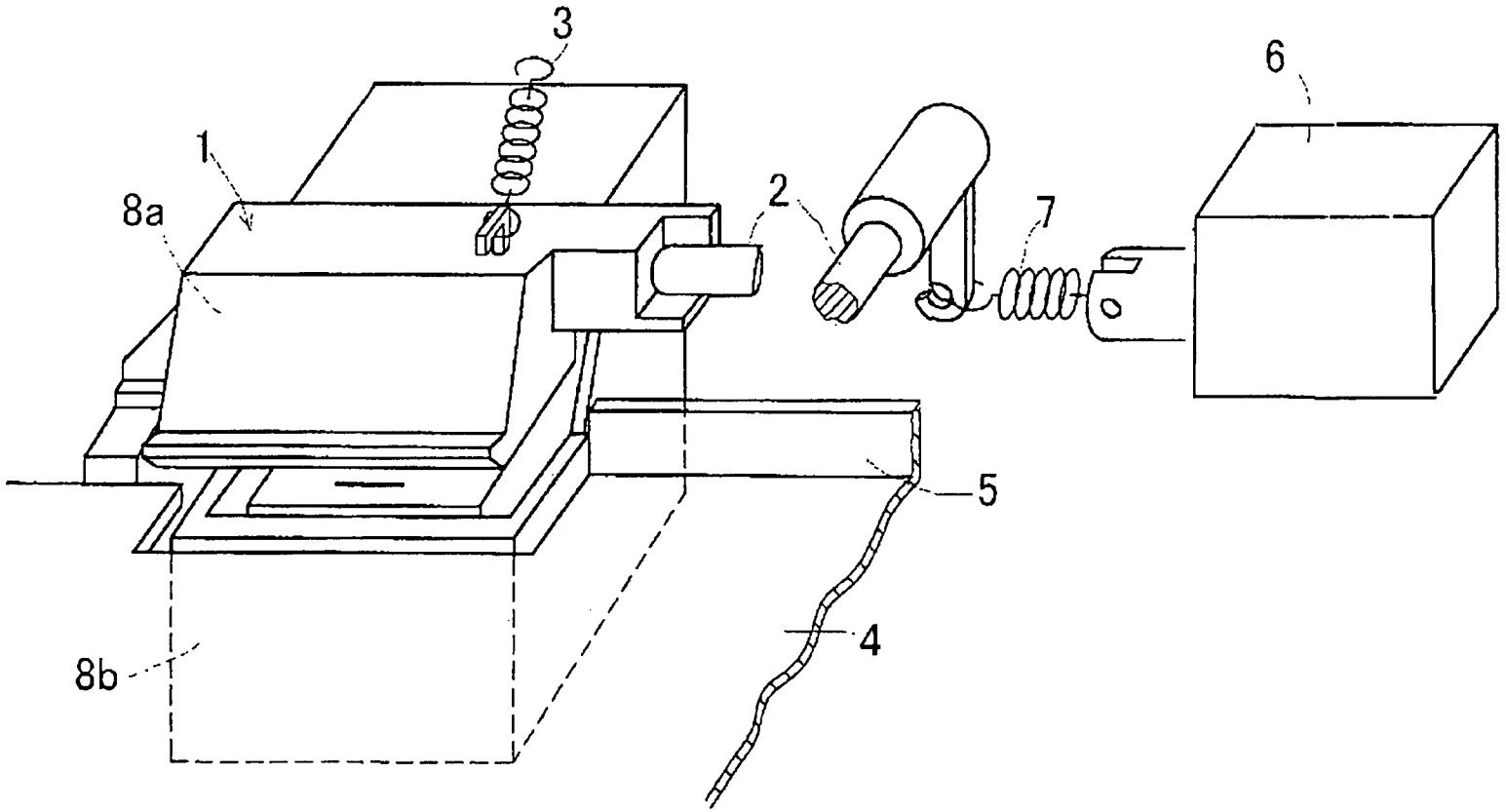
FIG. 1 is a view showing an essential portion of a stapler apparatus according to an embodiment of the present invention.
Figure 2A:
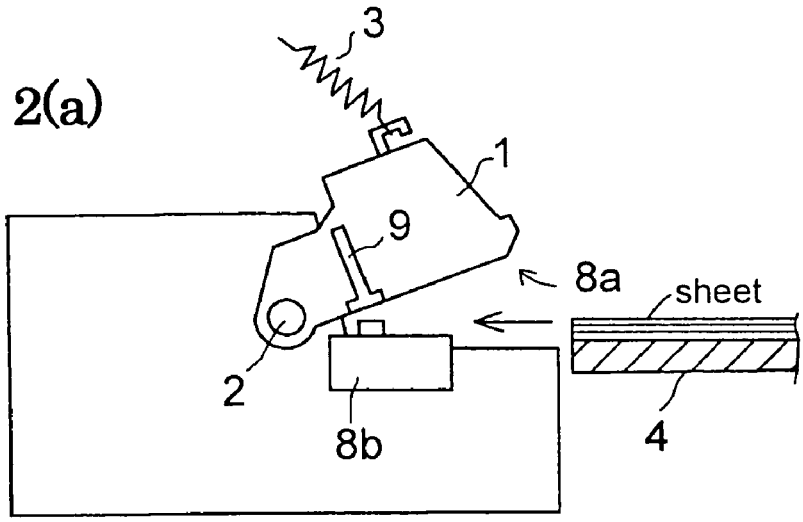
FIGS. 2(*a*) to 2(*c*) are views showing an operation of the stapler apparatus shown in FIG. 1.
Figure 2B:
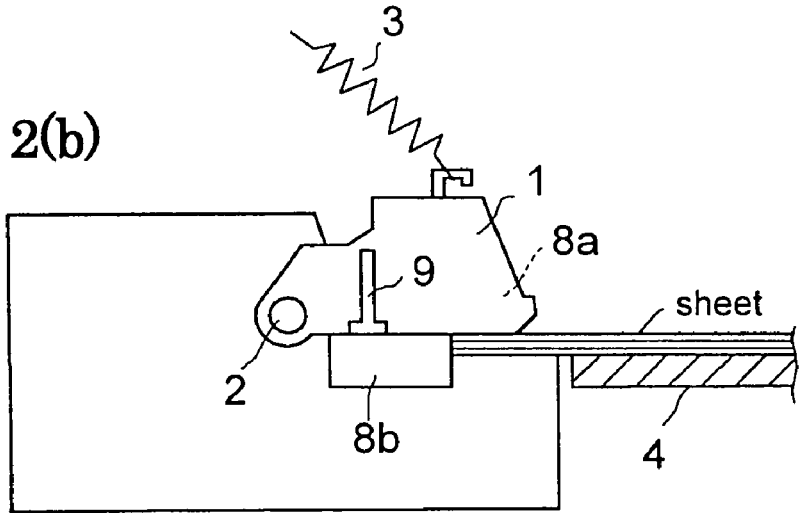
Figure 2C:
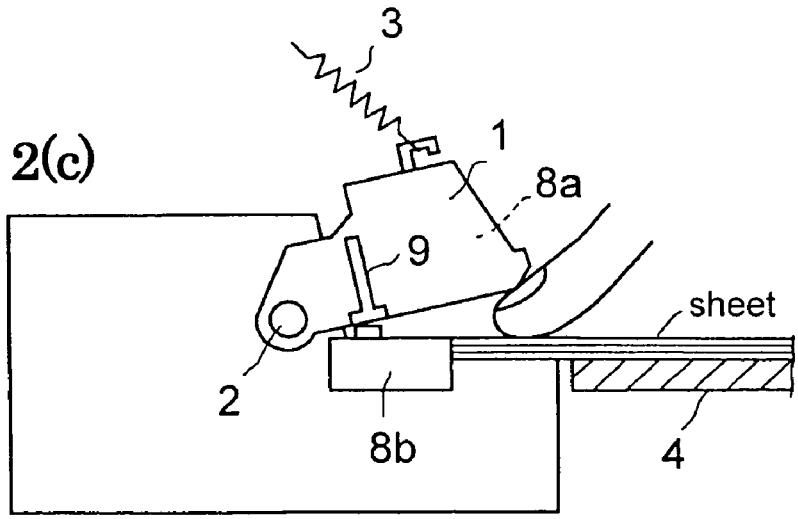
Figure 3A:
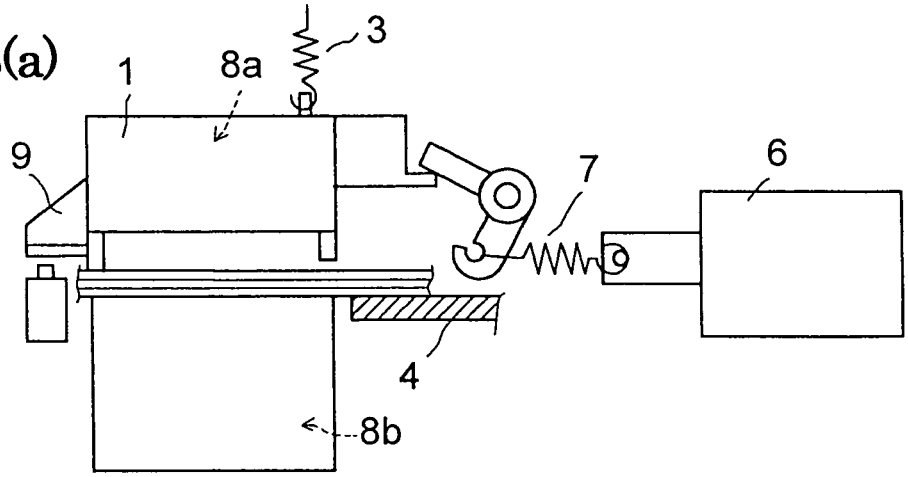
FIGS. 3(*a*) to 3(*c*) are views showing another operation of the stapler apparatus shown in FIG. 1.
Figure 3B:
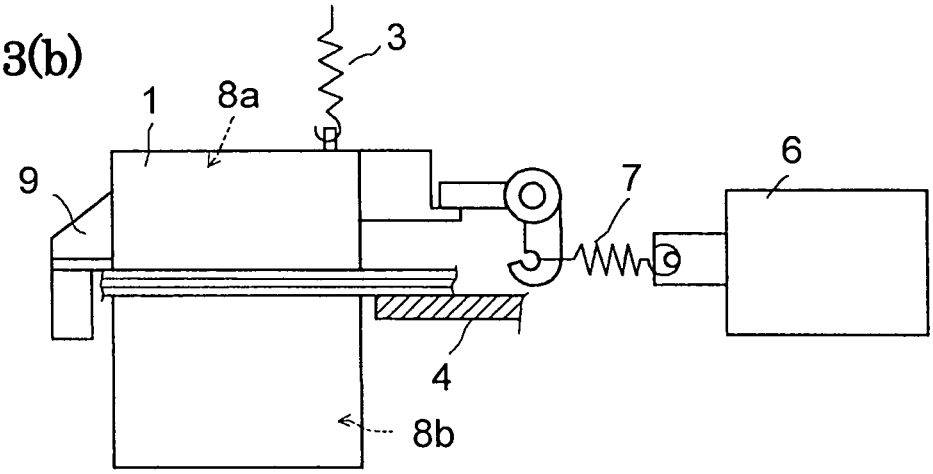
Figure 3C:
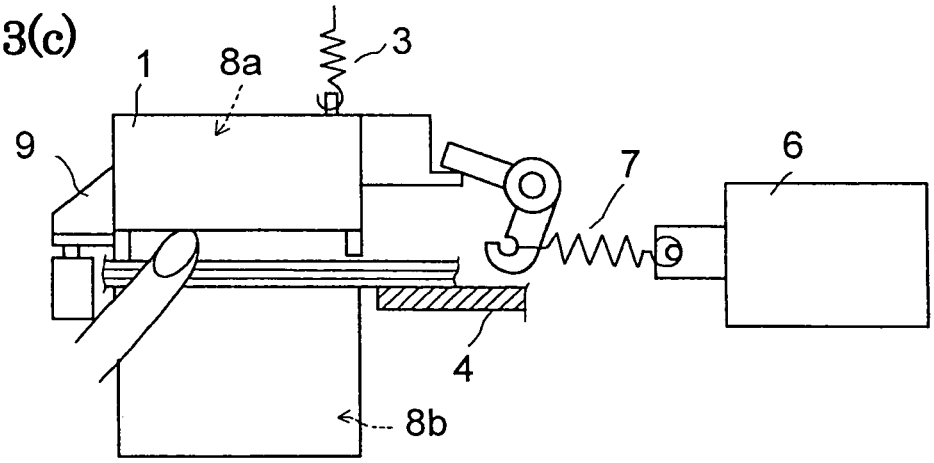

Hereunder, embodiments of the present invention will be explained with reference to the accompanying drawings. FIG. 1 is a view showing an essential portion of a stapler apparatus according to an embodiment of the present invention. FIGS. 2(*a*) to 2(*c*) are views showing an operation of the stapler apparatus shown in FIG. 1. FIGS. 3(*a*) to 3(*c*) are views showing another operation of the stapler apparatus shown in FIG. 1.

In FIG. 1, numeral 8*a* represents a head unit of a stapler, and is equipped internally with staple driving means. Numeral 8*b* represents an anvil unit, and comprises bending means for bending a leading end of a staple. The head unit 8*a* and the anvil unit 8*b* are arranged separated from each other on an apparatus frame. A cartridge storage unit is disposed in the head unit 8*a* for detachably storing a staple cartridge that stores staples internally.

Generally, a plurality of straight staples is joined together by adhesive to form a band, or belt. The band of linked straight staples is supplied in either a roll form or sheet form to be stored in the cartridge case. Thus, the cartridge with the straight staples is detachably stored in the head unit 8*a* as a consumable part. Staple drive means is composed of a cartridge storage unit, a former member for bending the staples sequentially drawn from the cartridge into U-shapes, a driver member for driving the staples bent into U-shapes into a sheet bundle, and a die member for forming the staples into U-shapes together with the former member. Also, a drive cam and drive motor are mounted to the apparatus frame mounted with the head unit 8*a* for moving the former member and driver member.

Bending means for bending the leading ends of staples driven into a sheet bundle is equipped on the anvil unit 8*b*. The bending means is comprised of grooves for guiding the leading ends of the U-shaped staple driven through the sheet bundle inwardly. The U-shaped staples are forcefully driven through the sheet bundle with the head unit 8*a*, and the leading ends thereof are bent inwardly. The head unit 8*a* and anvil unit 8*b* are rotatably mounted on the apparatus frame to contact and separate from each other around a rotating shaft. A drive cam driven by a drive motor attached to the apparatus frame moves the head unit 8*a* and anvil unit 8*b* to contact and separate from each other around the rotating shaft.

When the drive motor mounted to the apparatus frame is started, the drive cam, such as an eccentric cam, rotates to forcibly move the head unit 8*a* to the anvil unit 8*b* side. The internal driver member and former member also move to the anvil unit 8*b* side along with the movement of the head unit 8*a*. In the process of the movement, the former member bends the leading ends of the band-shaped stable supplied from the staple cartridge into a U-shape. At this time, the die member supports the center of the staple as a staple pedestal or stage to form the staple into a U-shape using the pressing force of the former member. After the former member moves, the driver member moves to push and move the die member and former member away from the U-shaped staple position. Next, the driver member strikes the central portion of the U-shaped staple to press it firmly downwardly. Accordingly, the staple pierces through the sheet bundle and the leading ends thereof reach the anvil unit 8*b* to be bent inwardly, thereby completing the stapling operation.

After the stapling operation, an urging spring or the reverse rotation of a drive motor returns the head unit 8*a* to a home position away from the anvil unit 8*b*. In the recovery process, the staples in the cartridge are drawn forward to prepare for the next stapling operation. The internal configurations of the head unit 8*a* and anvil unit 8*b* are widely known. An example has been described in U.S. Pat. No. 6,616,027.

The stapling mechanism described above has the following configuration. In FIG. 1, reference numeral 4 represents a sheet guide, and is composed of a tray member for stacking sheets to be stapled in bundles. When the sheet guide is attached to other function apparatus such as a sheet finishing apparatus, the sheet guide is composed of a sheet transport guide or a temporary stacking tray to temporarily stack sheets.

Reference numeral 5 in FIG. 1 represents a sheet aligning member formed by bending an end of the sheet guide 4 for abutting against ends of the sheets on the sheet guide for alignment. The sheet bundles stacked on the sheet guide 4 are aligned by the aligning member 5, and are then stapled at a predetermined position on the sheet. The cover member 1 is constantly urged to a state to open a stapling space by an urging spring 3 (See FIG. 2(*a*)). The solenoid 6 is mounted to the cover member 1 to rotate around the support shaft 2 against the urging spring 3. Reference numeral 7 is an adjuster spring for absorbing a thickness of the sheet bundle when the solenoid 6 is pulled inwardly.

Figure 6:
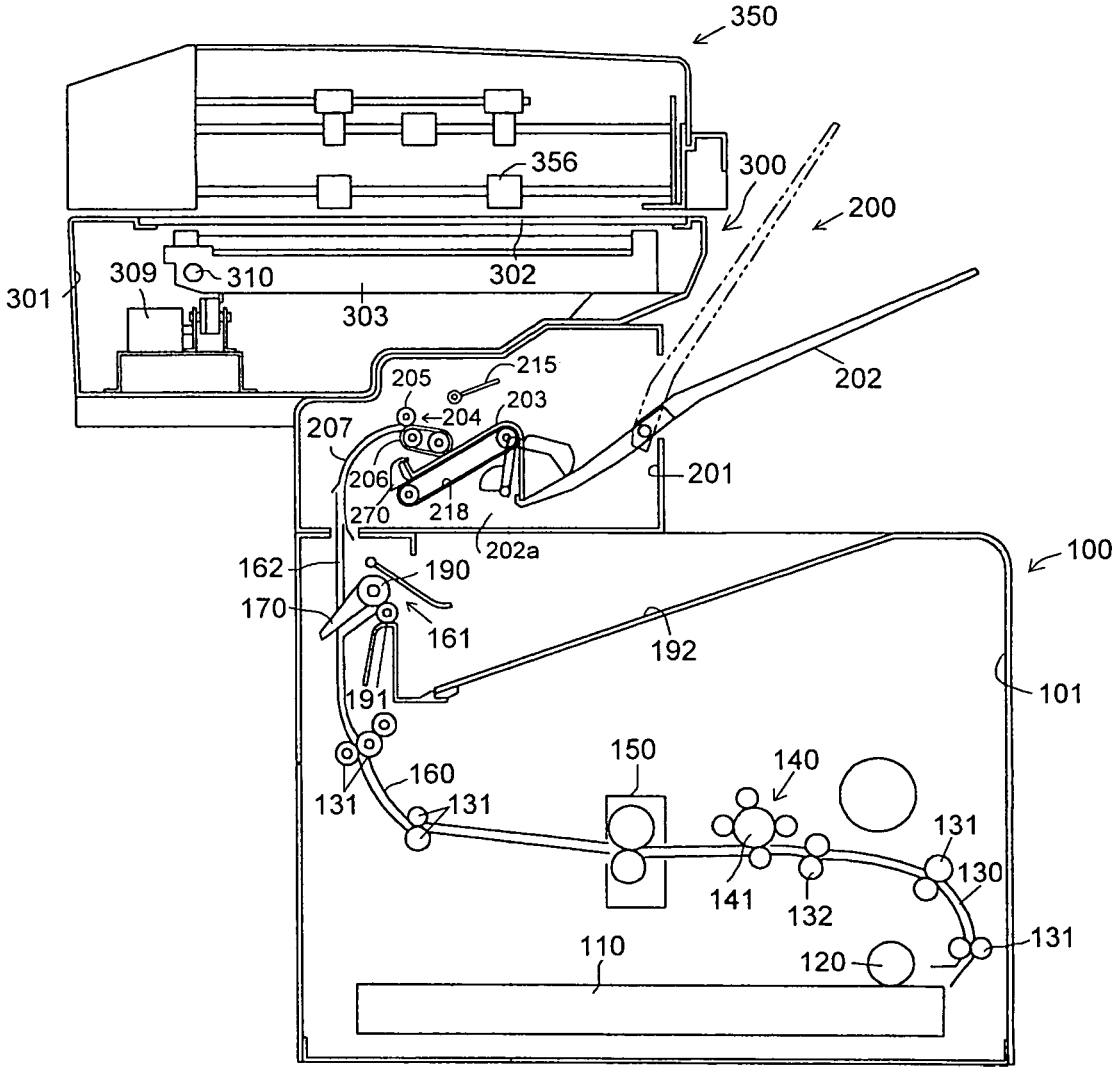
FIG. 6 is an overall view of an image forming apparatus having the sheet finishing apparatus provided with the stapler apparatus shown in FIGS. 1 to 3(*c*)
Figure 7:
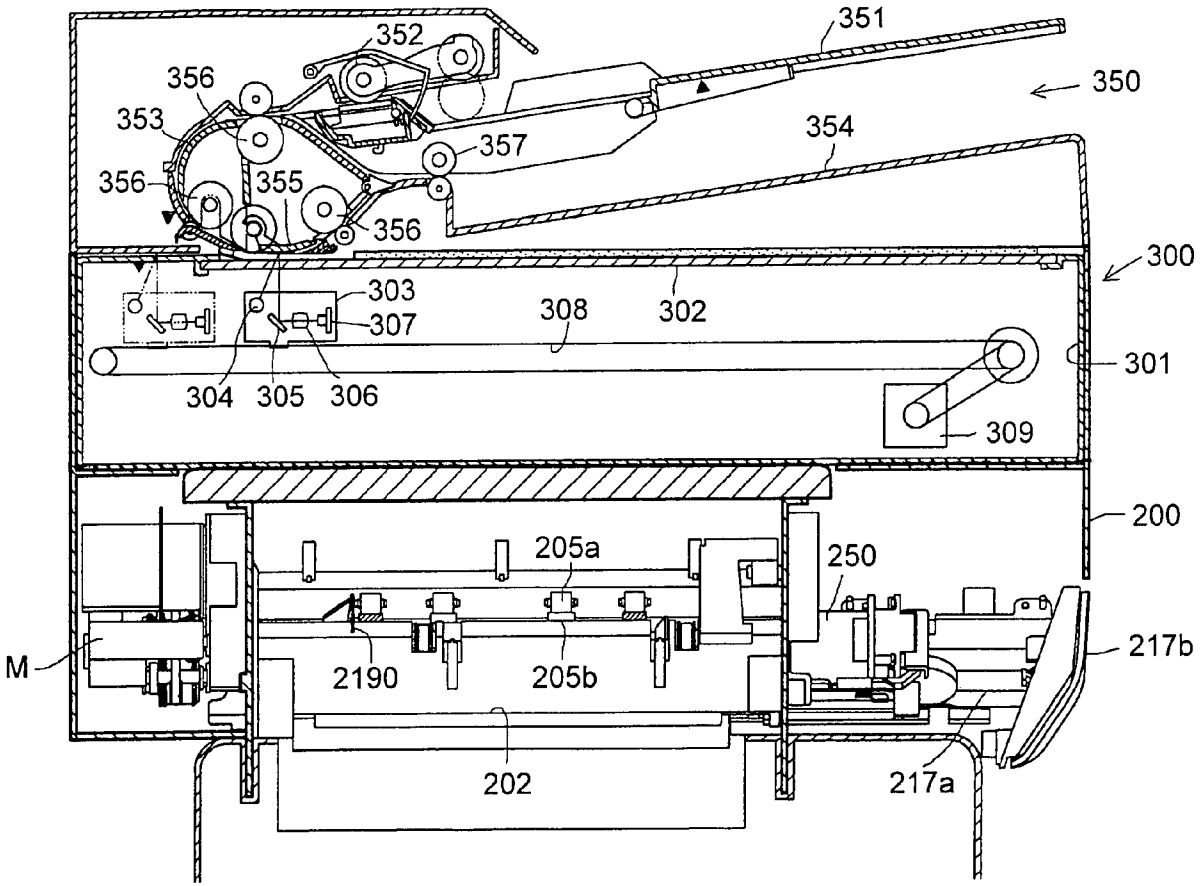
FIG. 7 is a longitudinal sectional view of the sheet finishing apparatus shown in FIG. 6.
Figure 8:
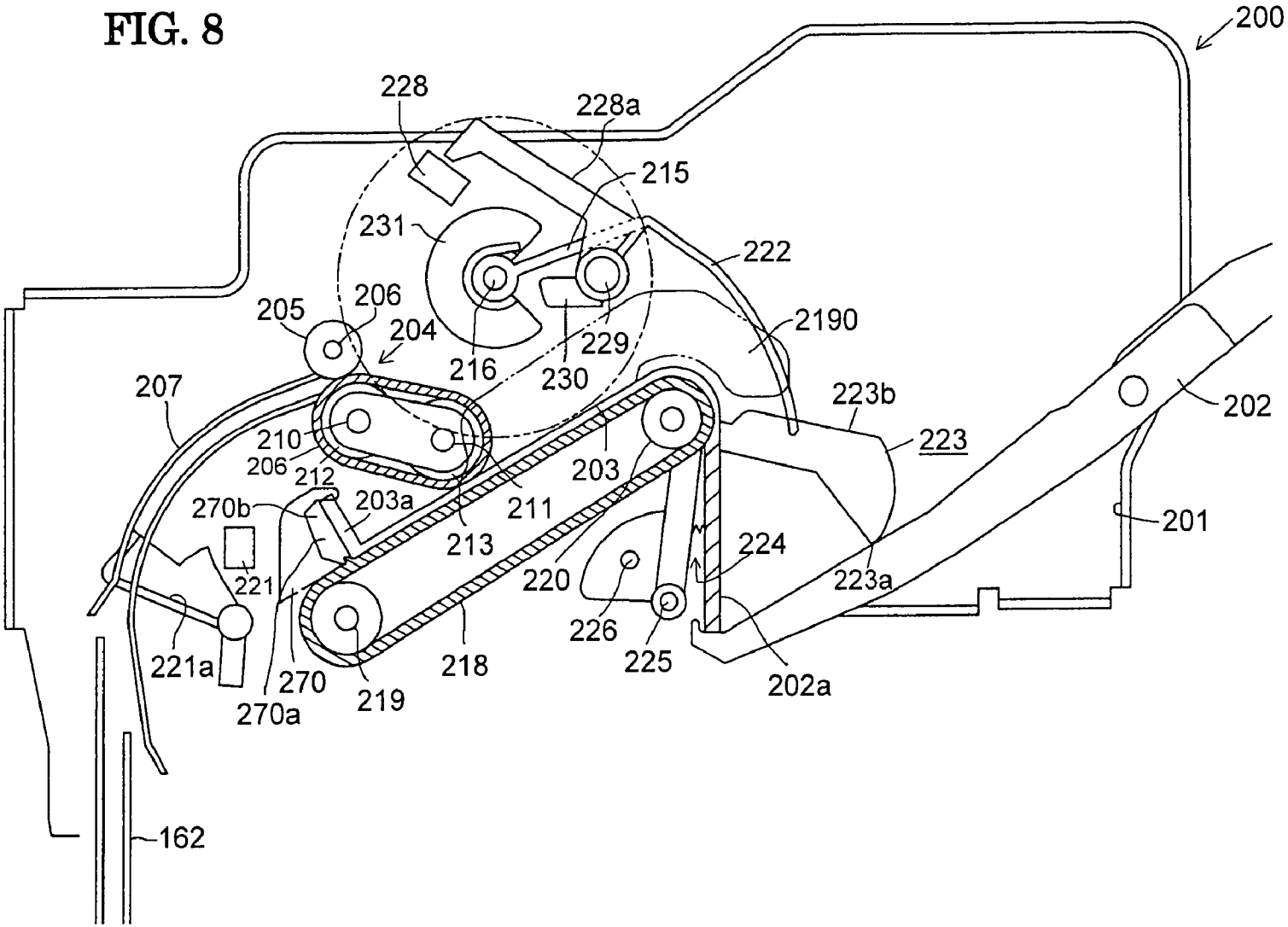
FIG. 8 is a view showing an essential portion of the sheet finishing apparatus shown in FIG. 6.

An embodiment of a sheet finishing unit provided with the stapler apparatus describe above will be explained in reference to FIGS. 6 to 8. FIG. 6 shows an overall system of an image forming apparatus. FIGS. 7 and 8 show an essential portion thereof. The image forming apparatus shown in FIG. 6 includes an image forming unit 100, a sheet finishing unit 200, an image reading unit 300, and an original feeding unit 350, and combines each unit into a casing for a variety of uses. The image forming unit 100 can be used as an output printer connected to a computer, for example, or as a copier connected to the image reading unit 300.

The paper cassette 110, printing means 140 and fixing means 150 are combined in the casing 101. The paper cassette 110 is detachably incorporated in the casing 101 for storing a predetermined number of sheets (not shown). When the paper feed roller 120 touches the uppermost sheet in the paper cassette 110, a corner pawl (not shown) prevents a second and subsequent sheet from being drawn or kicked out. Therefore, when the paper feed roller 120 rotates, only the uppermost sheet is separated and drawn into the transport path 130.

The transport roller 131 feeds the sheet in the transport path 130 to a pair of register roller 132. A variety of print means 140 are known. It is possible to employ, for example, an ink jet printing system, a thermal transfer printing system, or an offset printing system. An electrostatic printing system is shown in the embodiment. Reference numeral 141 shown in FIG. 6 is an electrostatic drum (photosensitive body). A predetermined latent image is drawn with a laser beam emitting device, and a developer affixes the image with toner ink. Then, the register rollers 132 align the leading edge of the sheet and the latent image on the electrostatic drum is sequentially transferred to the sheet with the toner ink. Reference numeral 150 represents fixing means formed of heating rollers pressing together. The rollers feed the sheet to the discharge path 160 while fixing the toner ink on the sheet. The discharge rollers 161 and discharge rollers 190 and 191 are disposed at an outlet of the discharge path 160. A discharge stacker 192 extends from the discharge outlet.

After the printing means 140 prints the predetermined image on the sheet fed from the paper cassette 110 and the sheet is fixed at the fixing means 150, the sheet is stacked and stored in the discharge stacker 192 via the discharge outlet 161. The linking path 162 is disposed on the discharge path 160 for guiding the sheets to the sheet finishing unit 200. A switching gate 170 selects whether the sheet is fed to the discharge outlet 161 or to the linking path 162. Specifically, drive means, such as a solenoid, is disposed in the switching gate 170, so that the path 160 communicates with the linking path 162 and the switching gate 170 rotates by a predetermined angle in the counterclockwise direction from the state shown in FIGS. 2(*a*) to 2(*c*) to close the path toward the discharge outlet 161.

The sheet finishing unit 200 includes a casing 201; the finishing means such as a stapler for binding a predetermined number of the sheets supported on the support tray into bundles, a punch for punching holes at a predetermined position on the sheets, and a marker for marking the sheets; the support tray 203 for temporarily holding the sheets; and a discharge stacker 202 for storing the sheets after being finished. The sheet finishing unit 200 is mounted on the image forming unit 101, as shown in FIG. 7. The discharge roller 205 and belt roller caterpillar belt 206 are arranged at the discharge outlet 204 of the transport path 207 connected to the linking path 162 of the image forming unit 100. The discharge roller 205 and belt roller caterpillar belt 206 are arranged to press together to discharge the sheets to the right side in FIGS. 2(*a*) to 2(*c*).

The support tray 203 is disposed below the discharge outlet 204 for temporarily holding the sheets, and the discharge stacker 202 is arranged below the support tray 203 at a different level so that the sheets fall therein. Accordingly, the sheets formed with images with the image forming unit 100 are led from the linking path 162 to the transport path 207 in the sheet finishing unit 200, and stored in the support tray 203 after passing through the discharge outlet 204. The sheets processed at the support tray 203 are then stored in the discharge stacker 202. The sheet finishing apparatus is described in further detail below.

In the image forming apparatus, the scanner unit 300 for reading an image is mounted above the sheet finishing apparatus together the original feeding unit 350. The scanner unit 300 includes a casing 301; a platen 302 for setting an original; a carriage 303 capable of moving along the platen 302; a light source 304 mounted on the carriage 303; a mirror 305; a lens 306; and photoelectric conversion elements 307. The carriage is held on the guide rail 304. The carriage moves to the left and right direction in FIG. 7 by a drive motor 309 connected to an endless belt 308 and pulleys. Hidden lines in the drawing represent a home position of the carriage 303.

The carriage 303 moves to the right side in FIG. 7 from the home position when the read start signal is sent to start reading the image on the original set on the platen 302. During the movement, light from the light source is reflected on the original surface and is directed through the lens 305 by the mirror 305 to the photoelectric conversion elements 307 where an image is formed. The image is converted into electrical signals and output. A regular scanner apparatus is composed of the photoelectric conversion elements 307 shown in the drawing output the accumulated electric charge of the light reflected from the original by a CCD (charge coupled device) to an external device at a predetermined clock speed. The electrical signal is sent to the image forming apparatus or an external computer as image data.

The original feeding unit 350 is mounted on the scanner unit 300 as an attachment. The original feeding unit 350 is composed of an original feeding tray 351; a paper feed roller 352 for separating the sheets into a single sheet and feeding the sheets from the tray; the paper feed path 353 for guiding the original from the paper feed roller 352 to the platen 302 on the scanner unit 300; and the discharge tray 354 for storing the originals from the paper feed path 353.

Reference numeral 355 in the drawing represents a backup plate disposed in a position corresponding to the platen 302 in the paper feed path 353 for supporting a backside of the original at the reading position to prevent blurring of the images on the original. In the drawings, reference numeral 356 represents a pair of transport rollers disposed in the paper feed path 353. Reference numeral 357 in the drawing represents a pair of discharge rollers.

The originals are set on the original feeding tray 351, and upon receiving the start signal, the originals are sent sequentially to the reading position on the paper feed path 353. At this point, the carriage 303 in the scanner unit 300 is stationary at the position delineated by solid lines in FIG. 7 to optically read an original at a predetermined constant speed. The original is then stored in the discharge tray 354 via the discharge roller 357.

In the sheet finishing unit 200 described above, the sheet with the images formed thereon at the image forming unit 100 is led from the linking path 162 in the image forming unit 100 to the transport path 207 in the sheet finishing unit 200. The support tray 203 is arranged below the discharge outlet 204 in the transport path 207 for temporarily supporting the sheets. The discharge stacker 202 is arranged below the support tray 203. With this configuration, the sheets from the discharge outlet 204 are transported to the support tray 203, and then to the discharge stacker 202.

As shown in FIGS. 6 and 8, the discharge roller 205*a* and discharge belt are arranged at the discharge outlet 204, and press against each other for nipping the sheets. The discharge belt 206 is a caterpillar belt placed between a pair of pulleys 212 and 213, and is formed of a rubber belt having protrusions on a surface thereof. The pulley shaft 210 for the pulley 212 is rotatably mounted to the apparatus frame. The other pulley 213 is supported on the bracket 214 and is disposed below the pulley shaft 210. The pulley 213 swings up and down in FIG. 8.

The discharge belt 206 touches the sheet stacked on the support tray 203 at a side of the pulley 213, while the belt lowers or rises according to an amount of the sheets stacked on the support tray 203. The drive motor (described below) is connected to the pulley shaft 210 to rotate in the clockwise direction in FIG. 8. The discharge roller 205*a* is formed of a follower roller (or idle roller) to press against the discharge belt 206. The paddle 215 is arranged at the discharge outlet to sweep off the sheets on the discharge belt 206. The paddle 215 includes a rubber member mounted to the rotating shaft 216 rotatably supported on the apparatus frame. The leading edge of the paddle 215 rotates in a direction shown by hidden lines in FIG. 8 to touch the discharge belt 205 and the support tray 203. A plurality of the discharge rollers 205*a*, discharge belts 206 and the paddles 215 are disposed in the sheet width direction (perpendicular to the transport direction). Two discharge rollers 205*a* and discharge belts 206 and three paddles 215 are disposed at left and right sides in the sheet width direction.

The support tray 203 for temporarily holding the sheets from the discharge outlet 204 has a space enough to stack the sheets, and is vertically arranged along with the discharge stacker 202. The support tray 203 and discharge stacker 202 are obliquely arranged so that the leading edge of the sheet is higher that the trailing edge of the sheet. The stopper wall 203*a* and 202*a* are disposed at the trailing edge side to align the trailing edge of the sheet. The sheets from the discharge outlet 204 are initially transported along the support tray 203, and then stacked with the trailing edges thereof aligned to the stopper wall 203*a*. The sheets are then stacked and stored on the discharge stacker 202 after being finished with the trailing edges thereof aligned to the stopper wall 202*a*.

The support tray 203 may have a size longer than a length of the sheet in the transport direction (left to right directions in the FIG. 1). In the embodiment, the support tray 203 has a smaller (or shorter), thereby making the apparatus compact. The trailing edge of the sheet, or at least of the longest sheet can be supported by the support tray 203, and the leading edge can be supported by the discharge stacker 202 in a bridge form. The support tray 203 is provided with aligning means for aligning the discharged and stacked sheets at a reference position; finishing means for finishing the sheets by punching holes, stapling or marking; and sheet pushing means for moving the sheets to the discharge stacker 202.

The aligning member 2190 is disposed on the support tray 203, and is a plate for aligning the side edges of the sheets in a direction perpendicular to the sheet transport direction. The aligning plate 2190 is provided with a rack gear on a backside (opposite to the sheet stacking surface) of the support tray 203. A pinion connected to a drive motor capable of both forward and reverse rotations engages the rack. Therefore, the aligning member 2190 moves on the support tray 203 for a predetermined amount to touch the side edges of the sheets on that tray to align the sheets in the width direction. The stapler apparatus 250 is mounted on the support tray 203 in the sheet width direction at a position facing the aligning member 2190 (see FIG. 6). The stapler apparatus 250 with the structure described above will be explained in further detail later.

An operation of the apparatus according to the embodiment will be explained next. The sheets with the images formed by the image forming unit 100 are sent sequentially to the discharge path 160. At this time, if the mode for finishing the sheets is selected, the switching gate 170 on the discharge path moves in the counterclockwise direction from the state shown in FIG. 6 to a position for guiding the sheets into the linking path 162. The sheets from the linking path 162 are sent to the transport path 207 and sequentially discharged from the discharge outlet 204.

At this time, the discharge roller 205*a* and discharge belt 206 rotate to discharge the sheets from the discharge outlet when the sheet discharge signal is received from the image forming unit 100. The leading edge of the sheet advanced into the transport path 207 activates the sensor lever 221*a* to detect the leading edge of the sheet at the sensor 221. The subsequent actions are controlled by the timing signal of the sensor 221.

The sheet fed to the discharge outlet is then fed along the support tray 203 and to the discharge stacker 202. The sheet overlaps the stacker and tray so that the leading edge of the sheet is supported on the discharge stacker 202 and the trailing edge thereof is supported then on the support tray 203. The paddle 215 rotates in the clockwise direction of FIG. 8 when the signal is received from the sensor 221 at the timing for the trailing edge of the sheet to be sent to the support tray 203. The leading end of the paddle 215 moves the sheet on the support tray 203 in the direction opposite to the transport direction (left side in FIG. 8). The leading edge of the sheet advances between the discharge belt 206 and the support tray 203, then the rotation of the discharge belt 206 pushes the trailing edge of the sheet to the stopper wall 203*a* where the sheet stops. After the sheet stops on the support tray 203, the discharge belt 206 idles over the sheet.

The aligning member 2190 moves in the sheet width direction perpendicular to the transport direction, after the sheet is sent to the support tray 203 with the signal from the sensor 221. As described above, the aligning member 2190 is formed of a plate member for touching the side edges of the sheets, and reciprocally moves between a retracted position away from the region where the sheets are transported to the support tray 203 and an aligning position for offsetting the sheets to a predetermined setting position. Specifically, the aligning member 5 shown in FIG. 1 is disposed on the support tray 203 (sheet guide in FIG. 1) at a position opposite to the aligning member 2190 for aligning the widths of the sheets against the aligning means 5. In the same way, the next sheet from the discharge outlet 204 is transported to the support tray 203 and stacked on the preceding sheet. The sheets from the image forming unit 100 are also stacked on the support tray 203 in this way.

The sheet bundle is stacked on the support tray 203 at a predetermined setting position, and is located at the predetermined position where the stapler apparatus, head unit 8*a* and anvil unit 8*b* are arranged to sandwich the sheet bundle at a center and sides of the sheet bundle. When the last sheet transport out signal is received from the image forming unit 100, the sheet finishing unit 200 executes the stapling process (described below).

When the stapling process is completed, the sheet bundle on the support tray 203 is discharged to the discharge stacker 202 by the sheet pushing member 270 as shown in FIG. 8. The sheet pushing member 270 engages a groove formed in the support tray 203 and is movable in the left and right directions in FIG. 8. The endless belt 218 placed between the pair of pulleys 219 and 220 is disposed on the backside of the support tray 203. The sheet pushing member 270 is fastened to the endless belt 218 to move along the support tray 203 with the rotation of the endless belt 218. The sheet pushing member 270 is provided with a touching surface 270*a* for touching the trailing edge of the sheet and a pushing surface 270*b* for pushing the top surface of the sheet.

In FIG. 8, reference numeral 222 represents a full detection lever composed of an arm member rotatable around the shaft 229 for detecting an amount of the sheets stacked on the discharge stacker 202. A sensor actuator 228*a* unitized to the arm member turns the sensor 228 on and off. The full detection lever 222 is controlled to rise and lower in FIG. 8 with the cam 231 mounted on the rotating shaft 216 via the cam follower 230. The full detection lever 222 is retracted from the transport out path of the sheet by the cam 231. Accordingly, the full detection lever 222 does not interfere the transportation of the sheets to the support tray 203. Reference numeral 223 represents a sheet holding member composed of an arm member rotatable around the shaft 225 for holding the sheets on the discharge stacker 202 and preventing the sheets from getting out of order. A leading end of the sheet holding member surface 223*a* pushes the sheets in the discharge stacker 202, and the guide surface 223*b* guides the sheets on the support tray 203 to the discharge stacker 202. The sheet holding member 223 is constantly urged in a direction to push the sheets by the urging spring 224. A cam (not shown) rotates the cam follower 226 in the counterclockwise direction in FIG. 8 to store the sheets in the discharge stacker 202. The sheet holding member 223 pushes the uppermost sheet in the discharge stacker 202 after the sheet is stored.

In the stapler apparatus 250, the head unit 8*a* and anvil unit 8*b* are arranged on the sheet guide 4 (the support tray 203 in FIG. 6) at separated and opposing positions for sandwiching the sheets on the guide 4. The staple activating means for contacting and separating the head unit 8*a* and anvil unit 8*b* is connected to at least one of the units. More specifically, the anvil unit 8*b* is fastened to the apparatus main unit such as a finishing unit with the configuration shown in FIG. 1. A drive motor and actuating cam (for example, an eccentric cam) are mounted to the frame of the anvil unit 8*b*. The head unit 8*a* is supported on the frame of the anvil unit 8*b*. The head unit 8*a* is reciprocally moved by the actuating cam to contact and separate from the anvil unit 8*b*.

The cover member 1 (described below) opens and closes the staple operating space between the head unit 8*a* and the anvil unit 8*b*. The sensor means 9 is provided for detecting the opening status of the cover member 1. While a variety of sensor means 9 can be employed to detect the opening or closing status of the cover member 1, in the embodiment, a limit switch is disposed on the anvil unit 8*b* to operate with the cover member 1. The limit switch activates the sensor means 9 composed of a limit switch at a distance so that a finger does not enter between the cover 1 and the sheet guide 4.

Figure 4:
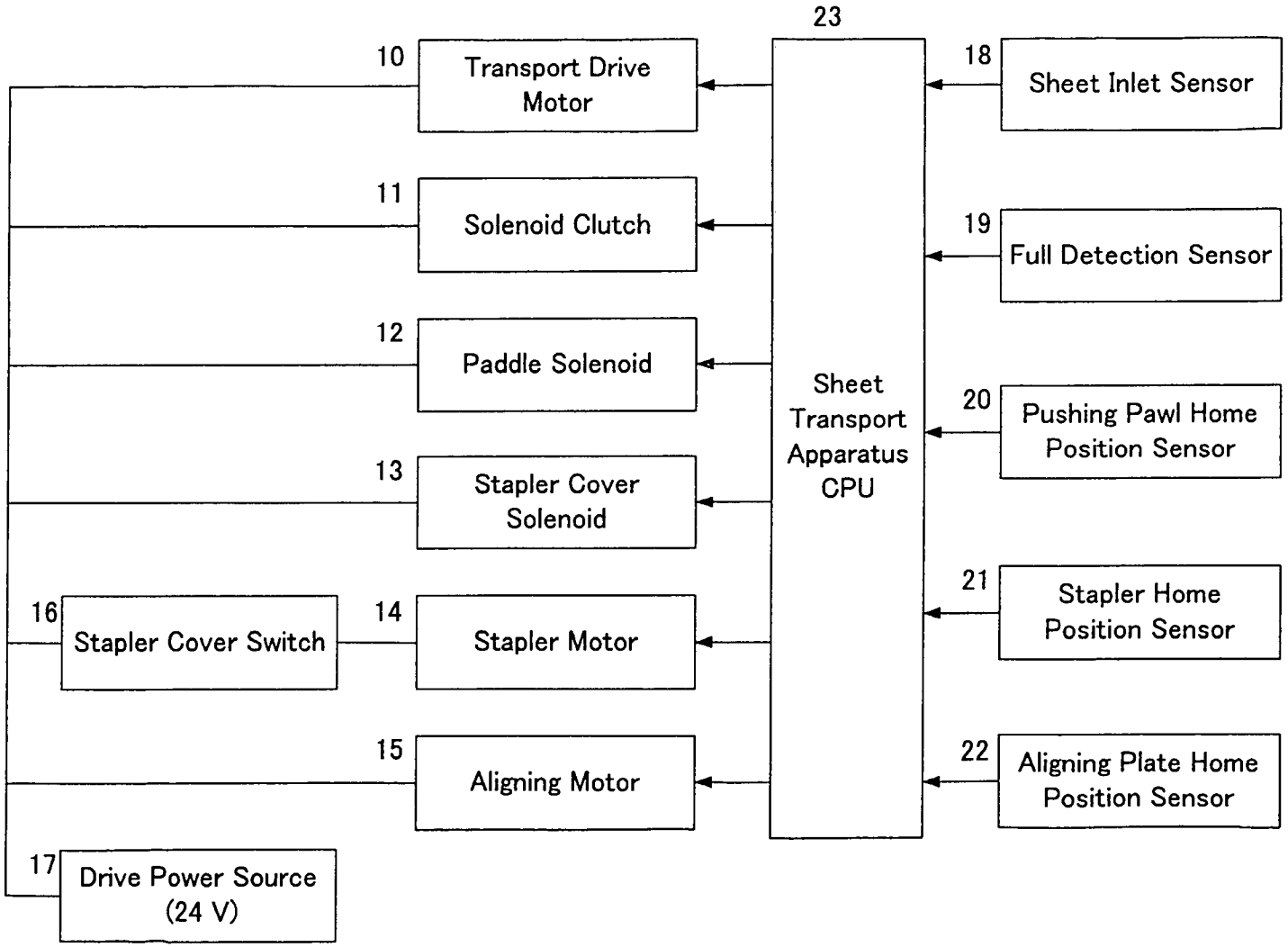
FIG. 4 is a block diagram of a control apparatus of the stapler apparatus shown in FIGS. 1 to 3(*c*)

The sensor means 9 is connected to the control unit of the sheet finishing unit 200 as shown in FIG. 4. The controller (sheet transport apparatus CPU) of the control unit in FIG. 4 is connected to the detection signal 18 from the sensor 221 on the transport path 207; the detection signal 19 from the full detection sensor 228; the detection signal 20 from the sensor for detecting the home position of the sheet pushing member 270; the detection signal 21 from the sensor means 19 (stapler home position); and the detection signal 22 from the aligning plate home position sensor for detecting the retracted position of the aligning member 2190. The controller 23 sends the command signal 10 to the drive motor M for driving the sheet transport system such as the discharge roller 205*a*; the command signal 11 to the solenoid clutch to control the sheet transport system; the command signal 12 for starting the rotation of the paddle 215; the command signal 13 to the solenoid 6 connected to the cover member 1; and the command signal 14 to the drive motor (staple activating means) on the stapler apparatus.

Figure 5:
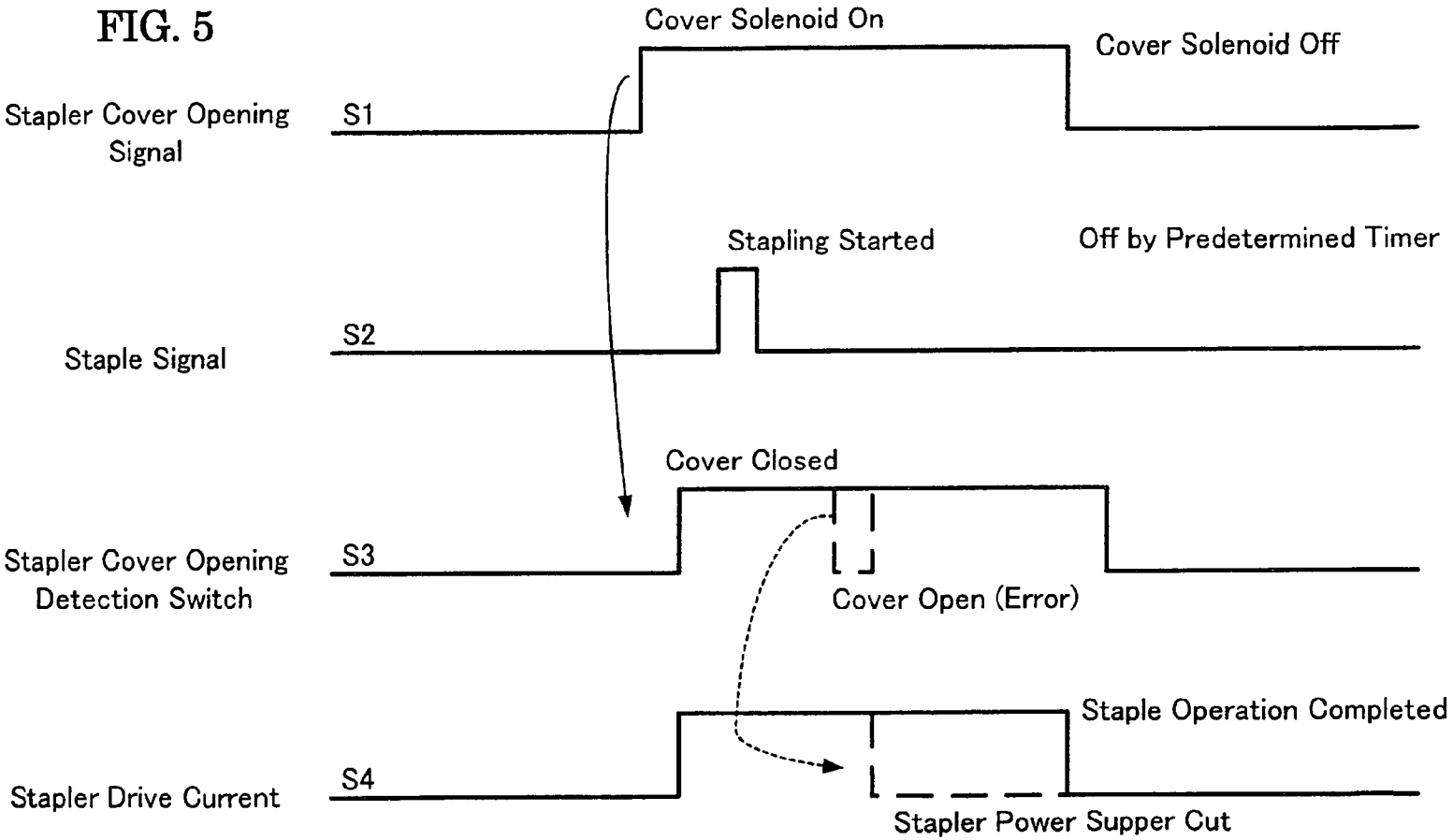
FIG. 5 is a timing chart of the operations of a sheet finishing apparatus provided with the stapler apparatus shown in FIGS. 1 to 3(*c*)

As shown in FIG. 5, when the staple signal S2 is sent as the command signals 13 and 14 from the control unit 23, the signal S1 is transmitted to the actuating solenoid 6 to start the supply of electrical power. At the same time, the signal S4 is transmitted to the drive motor of the stapling means to start the supply of electrical power. When the cover member 1 is not at a predetermined closed position, the cover member 1 is detected by the sensor means 9, and the electrical power to the stapling means is shut off. If the cover member 1 is positioned at the predetermined closed position, and the cover member 1 opens while the stapler is operating. The sensor means 9 detects that the cover member 1 opens, and shuts off the electrical power supplied to the actuating means.

According to this embodiment of the instant invention, the cover member is disposed to open and close the operating space between the head unit and the anvil unit. When the cover member is not positioned at the closed position, the action of the stapling means is prohibited, thereby eliminating the danger that an operator may insert a finger between the head unit and anvil unit when the stapler is operating.

Furthermore, the cover member covers the operating space of the stapler while the stapler is operating. The cover member may be formed of a sound-proof material, so that it is possible to reduce the noise, such as the sound of the parts striking when the stapler is operating.

Figure 9:
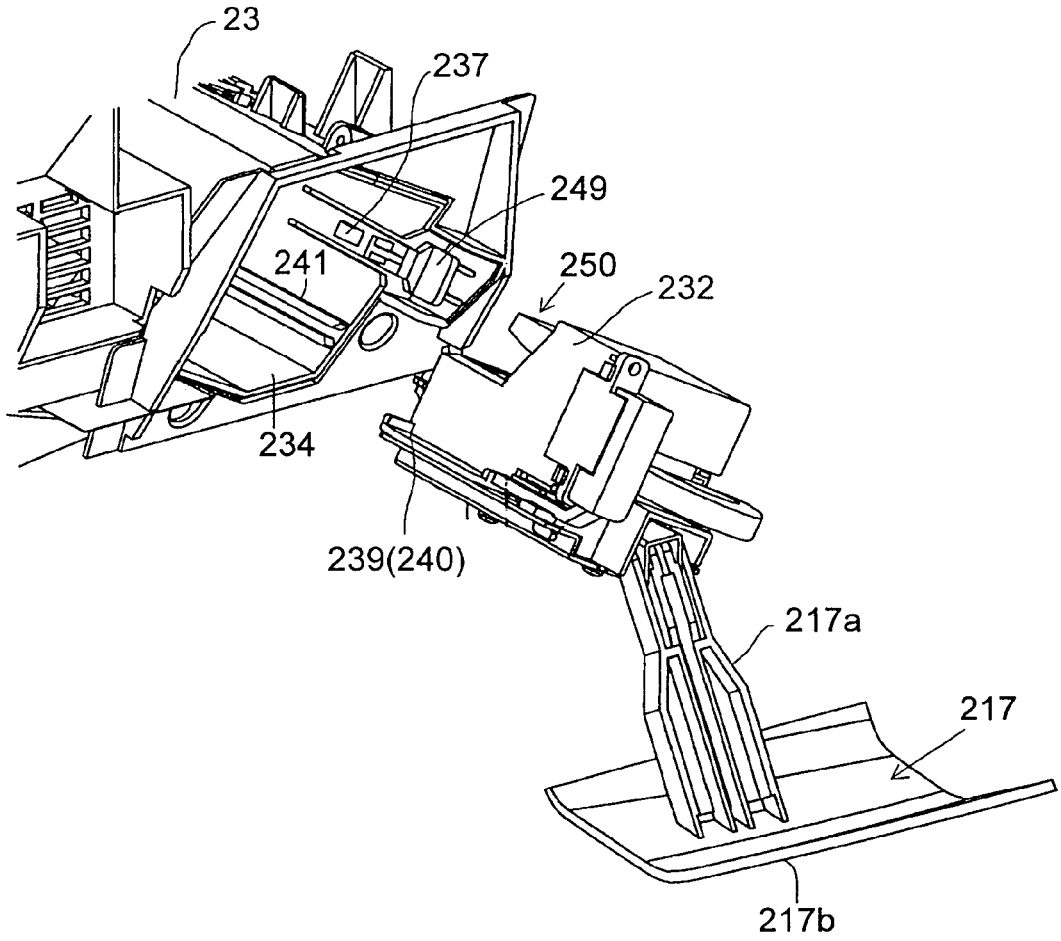
FIG. 9 is a perspective view showing a state that the stapler apparatus is mounted to and removed from the sheet finishing apparatus.
Figure 10:
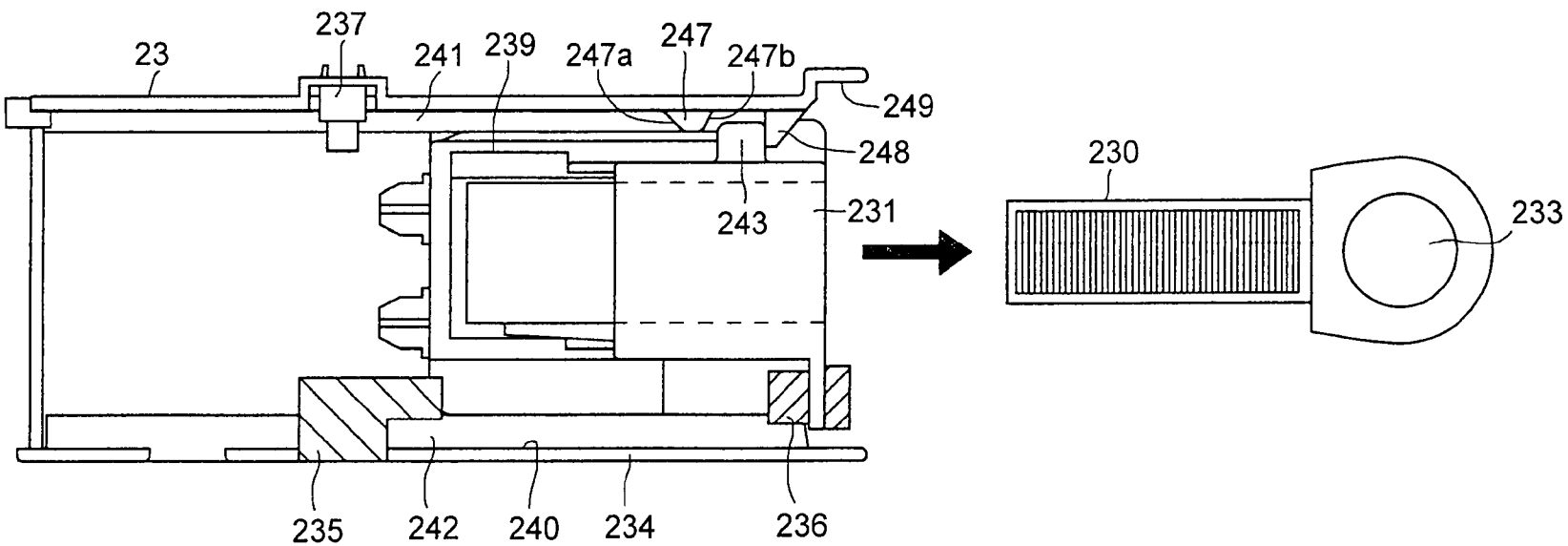
FIG. 10 is a view showing a state that a staple cartridge is mounted to and removed from the stapler apparatus.

An operation of mounting and dismounting the stapler apparatus 250 on the sheet finishing unit 200 will be explained next with reference to FIGS. 9 to 11. As described above, the stapler apparatus 250 includes the head unit 8*a* and anvil unit 8*b*. The following discussion will describe in further detail. The stapler apparatus 250 is composed of the bending block for bending the straight staples into the U-shape; the staple driver for driving the U-shaped staples into the sheet bundle; the staple body 232 having the anvil for bending the leading ends of the staples; and the staple cartridge 230 detachably mounted to the staple body 232.

There are a variety of known structures (not shown) for the staple driver, bending block and anvil. Normally, the staple driver and anvil are arranged at opposing and separated positions, and the head unit with the staple driver is moved to the anvil side with force by a cam connected to a drive motor to drive the staple through the sheet bundle and bend the leading ends of the staple when the staples strike the anvil pedestal (or stage). A band of the staples (described below) is bent into a U-shape when the former member with a U-shape mounted on the head unit lowers, while the staple is supported on the bending block. The U-shaped staple is driven by the driver disposed on the head unit, and is pierced into the sheet bundle. The leading ends strike the anvil unit and are bent further below the head unit.

Such a structure is retained in the staple body 232. Reference numeral 230 represents the staple cartridge for storing a sheet of the staples, i.e. a band of straight staples linked together by adhesive. Reference numeral 233 represents a handle to be grasped by an operator. The staple cartridge 230 is detachably mounted to a cartridge storage unit 231 on the stapler apparatus 250. A protrusion having elasticity is formed on one of the staple cartridge 230 and the cartridge storage unit 231, and a depression engaging the protrusion is formed on the other at positioned for engaging the protrusion. When the cartridge 230 is pulled forcefully, the engagement is released so that the staple cartridge 230 can be removed from the stapler apparatus 250.

Reference numeral 217 is an operating member attached to the stapler apparatus 250 for mounting and dismounting. The operating member 217 is connected to the stapler apparatus 250 with an interlocking unit 217*a*. The cover portion 217*b* that an operator can grasp is used as an outer cover of the sheet finishing apparatus.

The main guide unit 234 with the processing tray has the following structure for mounting the stapler apparatus 250 to the sheet finishing apparatus 207. The protrusions 239 and 240 are disposed on sidewalls of the stapler apparatus 250. The guide groove 241 engaging the protrusion 239 on one side and the guide groove 242 engaging the other protrusion 240 are disposed on the main unit guide unit 234. When the protrusions 239 and 240 engage the guide grooves 241 and 242 on the main unit guide unit, it is possible to mount or dismount the stapler apparatus 250 to the sheet finishing apparatus.

Reference numeral 235 is an apparatus main unit side connector connected to the power unit of the sheet finishing apparatus 20. Reference numeral 236 is a stapler apparatus side connector engaging the connector 235. When the connectors 235 and 236 are engaged, the electrical power is supplied to the drive motor of the stapler apparatus 250. Conversely, when the connectors are disconnected, the electrical power to the drive motor is cut. Reference numeral 237 represents a limit sensor disposed on the main unit guide unit 234 for detecting whether the stapler apparatus 250 is properly mounted at the activating position.

Reference numeral 243 represents a protrusion disposed on the stapler apparatus 250 for activating the limit sensor 237. Reference numeral 244 represents a positioning member disposed on the main unit guide unit 234 and having a hole for engaging a positioning protrusion 238 disposed on the stapler apparatus 250. Therefore, the stapler apparatus 250 slides left to right in FIG. 9 along the guide grooves 241 and 242 of the main unit guide unit 234. The positioning protrusion 238 engages the positioning member 244 at the staple activating (mounting) position to determine the accurate position, and the limit sensor 237 detects the state.

Figure 11A:
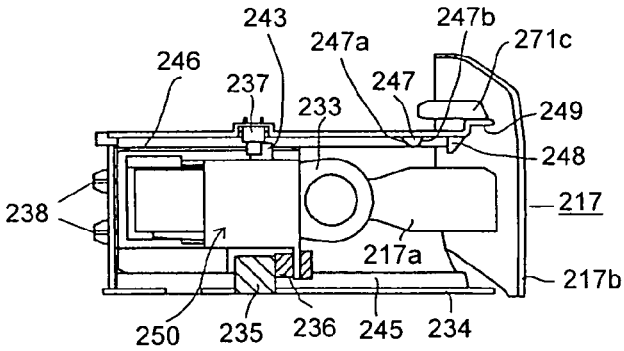
FIGS. 11(*a*) to 11(*c*) are views showing a state that the stapler apparatus is mounted to and removed from a guide member of the sheet finishing apparatus, wherein FIG. 11(*a*) shows a state that the stapler apparatus is mounted at an operating position, FIG. 11(*b*) shows a state that the stapler apparatus moves to a separated position, and FIG. 11(*c*) shows a state that the stapler apparatus is removed from the guide member.
Figure 11B:
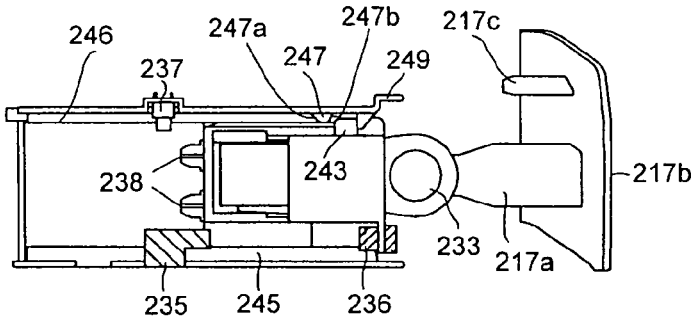
Figure 11C:
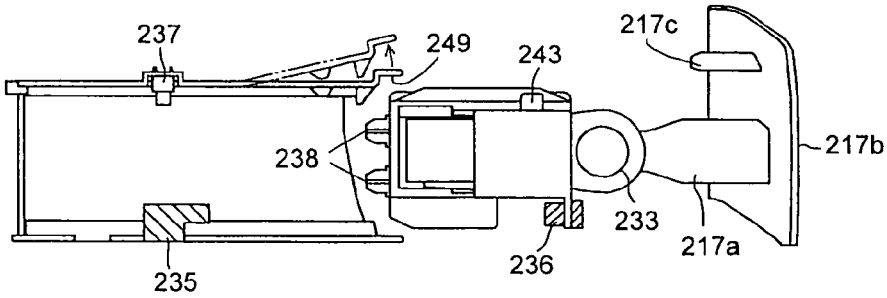

A snap spring is disposed on the guide unit 234 for holding the unit at the mounting position of the stapler apparatus 250 (see FIG. 11(*a*)). The guide walls 245 and 246 are also disposed for supporting the sidewall of the stapler apparatus 250. A locking member 247 locks the protruding member 243 on the unit in the state shown in FIG. 11(*b*) with the stapler apparatus 250 pulled outward, and the stopper pawls 248 are disposed on one guide wall 246 at two positions. The guide wall 246 is composed of an elastic material (compound plastic) to elastically deform from solid line shown in FIG. 11(*c*) to hidden line. When the stapler apparatus 250 is pulled out from the mounted state shown in FIG. 11(*a*) to the separated position shown FIG. 11(*b*), the protruding member 243 pushes the oblique surface 247*a* on the locking member 247 and strikes the locking pawls 248. Conversely, when the stapler apparatus 250 is pushed back to the mounting position, the oblique surface 247*a* on the locking member 247 is elastically deformed by the protruding member 243.

Accordingly, the protruding member 243 locks the stapler apparatus 250 at the locking pawls 248. By pulling the handle 233 on the staple cartridge 230, it is possible to remove only the staple cartridge 230 to outside the apparatus. To further remove the entire stapler apparatus 250, for example because of a failure in the staple body 232, it is possible to remove the staple cartridge 230 to outside by moving the operating piece 249 on the guide wall 246 in the arrow direction in FIG. 11(*c*) to retract the locking member 247.

With the configuration described above, the stapler apparatus 250 is mounted on the guide member 234 movably between the operating position and the separated position on the sheet finishing unit 200. The locking means 247 and 248 for fastening the stapler apparatus at the activating position and lock release means 249 for releasing the stapler apparatus at the separated position are mounted on the guide member 234. The removal means of the staple cartridge 230 is disposed on the stapler apparatus in a state that the guide member 234 holds the stapler apparatus 250 at the separating position. Accordingly, the stapler apparatus 250 moves from the activating position to the separated position in a state that the guide member 234 holds the stapler apparatus 250, so that the staples are replenished. It is also possible to remove the staple cartridge 230 in the state, thereby making it easy to remove the entire staple cartridge to replenish staples as compared with a conventional sheet finishing apparatus. It is possible to completely remove the stapler apparatus 250 at the separated position to remove staple jams or to repair the apparatus.

According to the embodiments of the instant invention, the cover member is disposed to open and close the operating space between the head unit and the anvil unit. If the cover member is not positioned at the closed position, the action of the stapling means is prohibited. Accordingly, it is possible to prevent the danger that an operator may insert a finger between the head unit and anvil unit when the stapler is operating.

Furthermore, the cover member covers the operating space of the stapler while the stapler is operating. The cover member may be formed of a sound proof material, so that it is possible to reduce the noise, such as sound of the parts striking together when the stapler is operating.

When the staples are replenished, the stapler apparatus is moved from the activating position to the separated position while being held with the guide member. The staple cartridge can be removed in this state completely from the sheet finishing apparatus to make it easy to replenish the staples. It is possible to completely remove the stapler apparatus at the separated position to remove staple jams or to repair the apparatus.

While the invention has been explained with reference to the specific embodiments of the invention, the explanation is illustrative and the invention is limited only by the appended claims.

What is claimed is:

1. A stapler apparatus comprising:

a support tray for stacking sheets in a bundle, a head unit arranged relative to the support tray and having staple drive means for applying a staple to the sheet bundle on the support tray, an anvil unit arranged relative to the support tray for bending the staple applied to the sheet bundle, staple operating means for moving the head unit to and away from the anvil unit, a cover member for opening and closing an operating space between the head unit and the anvil unit, the cover member being configured to concealingly enclose all of the head unit except for a side facing the anvil unit, and control means electrically connected to the staple operating means for controlling the staple operating means not to operate when the cover member is not located at a predetermined closed position.

2. A stapler apparatus according to claim 1, further comprising opening/closing drive means connected to the cover member for shifting the cover member in an opening direction and a closing direction so that the cover member freely opens and closes in a direction that the head unit moves, and moves between a position that the cover member touches the sheet bundle and a position that the cover member is separated from the sheet bundle.

3. A stapler apparatus according to claim 1, wherein said staple operating means comprises a drive motor, and said control means shuts off electrical power to the drive motor.

4. A sheet finishing apparatus comprising the stapler apparatus according to claim 1, discharge means for sequentially discharging the sheets for stapling the sheets by the stapler apparatus, and a discharge stacker for receiving the sheets on the support tray.

5. An image forming apparatus comprising the sheet finishing apparatus according to claim 4, image forming means for forming an image on the sheets, and transport means for transporting the sheets with the image formed by the image forming means to the sheet finishing apparatus.

6. A stapler apparatus according to claim 1, wherein the cover is configured to enclose the head unit in all operative positions.

7. A stapler apparatus according to claim 1, wherein said cover is configured to expose only the sheet bundle during stapling.

8. A stapler apparatus comprising:

a support tray for stacking sheets in a bundle, a head unit arranged relative to the support tray and having staple drive means for applying a staple to the sheet bundle on the support tray, an anvil unit arranged relative to the support tray for bending the staple applied to the sheet bundle, staple operating means for moving the head unit to and away from the anvil unit, a cover member for opening and closing an operating space between the head unit and the anvil unit, a solenoid operatively connected with the cover member by a spring which is configured to absorb a thickness of the bundle of sheet; and control means electrically connected to the staple operating means for preventing operation of the staple operating means when the cover member is not located at a predetermined closed position.

9. A stapler apparatus according to claim 1, wherein the cover member is configured to concealingly enclose all of the head unit and expose only the sheets which are stacked in a bundle.

* * * * *